US010563655B2

(12) United States Patent
Yahaba et al.

(10) Patent No.: US 10,563,655 B2
(45) Date of Patent: Feb. 18, 2020

(54) ROTARY COMPRESSOR FOR COMPRESSING REFRIGERANT USING CYLINDER

(71) Applicant: FUJITSU GENERAL LIMITED, Kanagawa (JP)

(72) Inventors: Shingo Yahaba, Kanagawa (JP); Akira Inoue, Kanagawa (JP); Kenshi Ueda, Kanagawa (JP); Yasuyuki Izumi, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 143 days.

(21) Appl. No.: 15/806,193

(22) Filed: Nov. 7, 2017

(65) Prior Publication Data

US 2018/0135630 A1 May 17, 2018

(30) Foreign Application Priority Data

Nov. 14, 2016 (JP) ..... 2016-221534

(51) Int. Cl.
*F03C 2/00* (2006.01)
*F03C 4/00* (2006.01)
(Continued)

(52) U.S. Cl.
CPC ..... *F04C 18/3564* (2013.01); *F04C 18/3568* (2013.01); *F04C 23/001* (2013.01);
(Continued)

(58) Field of Classification Search
CPC ..... F04C 18/3564; F04C 18/3568; F04C 23/001; F04C 23/008; F04C 27/005; F04C 29/028; F04C 29/12; F04C 2240/809
(Continued)

(56) References Cited

U.S. PATENT DOCUMENTS 7,802,972 B2 9/2010 Shimizu et al.
2011/0027117 A1 2/2011 Fujino et al.
(Continued)

FOREIGN PATENT DOCUMENTS

CN 101160468 A 4/2008
CN 202326242 U 7/2012
(Continued)

OTHER PUBLICATIONS

Extended European Search Report issued in EP Patent Application No. 17201179.3, dated Mar. 19, 2018.
(Continued)

*Primary Examiner* — Theresa Trieu
(74) *Attorney, Agent, or Firm* — McDermott Will & Emery LLP

(57) ABSTRACT

In a rotary compressor, a refrigerant path hole communicates with a lower discharge chamber concave portion while at least a part thereof overlaps the lower discharge chamber concave portion, is positioned between a lower vane groove and a first insertion hole in a lower cylinder, and is configured of a plurality of holes which are disposed between the upper vane groove and the first insertion hole in the upper cylinder, and a sectional area of a cross section which is closest to the lower vane groove and the upper vane groove of the plurality of holes is the smallest compared to the sectional area of the cross section of the other holes.

2 Claims, 4 Drawing Sheets

(51) Int. Cl.

| | |
|---|---|
| ***F04C 2/00*** | (2006.01) |
| ***F04C 18/356*** | (2006.01) |
| ***F04C 23/00*** | (2006.01) |
| ***F04C 27/00*** | (2006.01) |
| ***F04C 29/02*** | (2006.01) |
| ***F04C 29/12*** | (2006.01) |

(52) U.S. Cl.
CPC ..... *F04C 23/008* (2013.01); *F04C 27/005* (2013.01); *F04C 29/028* (2013.01); *F04C 29/12* (2013.01); *F04C 2240/809* (2013.01)

(58) Field of Classification Search
USPC ..... 418/11, 60, 63
See application file for complete search history.

(56) References Cited

U.S. PATENT DOCUMENTS

| | | | |
|---|---|---|---|
| 2013/0259725 | A1 | 10/2013 | Yahaba et al. |
| 2014/0250937 | A1 | 9/2014 | Hirayama |
| 2015/0078928 | A1 | 3/2015 | Wei et al. |
| 2015/0233376 | A1 | 8/2015 | Ogata et al. |
| 2017/0335848 | A1 | 11/2017 | Morozumi et al. |
| 2018/0023567 | A1 | 1/2018 | Tanaka et al. |

FOREIGN PATENT DOCUMENTS

| | | | |
|---|---|---|---|
| CN | 203081758 | U | 7/2013 |
| CN | 103362807 | A | 10/2013 |
| CN | 104428536 | A | 3/2015 |
| EP | 2 873 864 | A1 | 5/2015 |
| JP | 63-100285 | A | 5/1988 |
| JP | H11-132177 | A | 5/1999 |
| JP | 2003-227485 | A | 8/2003 |
| JP | 2005-351590 | A | 12/2005 |
| JP | 2014-009612 | A | 1/2014 |
| JP | 2014-145318 | A | 8/2014 |
| JP | 2014-231801 | A | 12/2014 |
| JP | 2016118142 | A | 6/2016 |
| WO | 2013/061879 | A1 | 5/2013 |
| WO | 2013/094114 | A1 | 6/2013 |
| WO | 2013/168193 | A1 | 11/2013 |
| WO | 2013/168194 | A1 | 11/2013 |
| WO | 2014/002457 | A1 | 1/2014 |
| WO | 2016/098710 | A1 | 6/2016 |
| WO | 2016/114016 | A1 | 7/2016 |

OTHER PUBLICATIONS

Search Report issued in corresponding International Patent Application No. PCT/JP2015/084844, dated Mar. 8, 2016 with English Translation.

Decision to Grant issued in corresponding Japanese Patent Application No. 2014-257818, dated Feb. 9, 2017, with English Translation.

Chinese Office Action issued in corresponding Chinese Patent Application No. 201580068370.1, dated May 31, 2018, with English Translation.

Extended European Search Report issued in corresponding European Patent Application No. 15869915.7, dated Nov. 23, 2018.

Non-Final Office Action issued in corresponding U.S. Appl. No. 15/537,394, dated Mar. 14, 2019.

ROTARY COMPRESSOR FOR COMPRESSING REFRIGERANT USING CYLINDER

CROSS-REFERENCE

This application is based upon and claims the benefit of priority of the prior Japanese Patent Application No. 2016-221534, filed on Nov. 14, 2016, the entire contents of which are incorporated herein by reference.

FIELD

The invention relates to a rotary compressor.

BACKGROUND

For example, in Japanese Laid-open Patent Publication No. 2014-145318, as a two-cylinder type rotary compressor, a technology in which a compressed refrigerant suppresses an intake refrigerant on an inlet chamber side of a lower cylinder and an upper cylinder from being heated, and a compression efficiency of the refrigerant is improved in a compressor, by disposing a refrigerant path hole through which a high-temperature compressed refrigerant which is compressed in the lower cylinder and is discharged from a lower discharge hole flows toward an upper end plate cover chamber (upper muffler chamber) from a lower end plate cover chamber (lower muffler chamber) at a position separated from the inlet chamber side of the lower cylinder and the upper cylinder, is described. In addition, in International Publication No. WO 2013/094114, a technology which suppresses that a high-temperature compressed refrigerant which is compressed in a lower cylinder and is discharged from a lower discharge hole heats a lower end plate and heats an intake refrigerant in an inlet chamber of the lower cylinder, and a compressor efficiency is improved, is described.

In the rotary compressor described in Japanese Laid-open Patent Publication No. 2014-145318, by inflating the lower end plate cover (lower muffler cover), the lower endplate cover chamber formed between the lower end plate and the lower end plate cover has a large capacity, and thus, an amount of a refrigerant which is compressed in the upper cylinder, is discharged from the upper discharge hole, reversely flows through a refrigerant path hole, and flows into a lower muffler chamber, is large.

In the rotary compressor described in International Publication No. WO 2013/094114, the refrigerant path hole with respect to the lower discharge hole provided on the lower end plate is disposed on a side opposite to the lower discharge valve accommodation portion, the refrigerant discharged from the lower discharge hole flows to the refrigerant path hole through the lower discharge valve accommodation portion, and thus, it is necessary to deepen the lower discharge valve accommodation portion. Therefore, the capacity of the lower end plate cover chamber (refrigerant discharge space) increases, and the amount of the refrigerant which is compressed in the upper cylinder, is discharged from the upper discharge hole, reversely flows through the refrigerant path hole, and flows into the lower muffler chamber, is large.

Here, a case where a sectional area of the refrigerant path hole for reducing the reverse flow of the refrigerant is reduced is considered, but when the sectional area of the refrigerant path hole is small, when the refrigerant which is compressed in the lower cylinder and is discharged from the lower discharge hole flows through the refrigerant path hole, there is a concern that a pressure loss increases due to a flow channel resistance, and the compression efficiency deteriorates. Furthermore, when the sectional area of the refrigerant path hole is small, since the flow channel resistance with respect to the refrigerant that flows through the refrigerant path hole increases, there is a concern that noise is generated.

SUMMARY

An object of the invention is to suppress a reverse flow of a refrigerant compressed in an upper cylinder through a refrigerant path hole, to reduce a flow channel resistance of the refrigerant that flows through the refrigerant path hole, and to prevent deterioration of an efficiency of a rotary compressor.

According to the invention, there is provided a rotary compressor which includes a sealed vertically-placed cylindrical compressor housing which is provided with a discharge pipe that discharges a refrigerant in an upper portion thereof, which is provided with an upper inlet pipe and a lower inlet pipe that suction the refrigerant in a lower portion of a side surface thereof, an accumulator which is connected to the upper inlet pipe and the lower inlet pipe that are fixed to a side portion of the compressor housing, a motor which is disposed in the compressor housing, and a compressing unit which is disposed below the motor in the compressor housing, is driven by the motor, suctions and compresses the refrigerant from the accumulator via the upper inlet pipe and the lower inlet pipe, and discharges the refrigerant from the discharge pipe, and in which the compressing unit includes an annular upper cylinder and an annular lower cylinder, an upper end plate which blocks an upper side of the upper cylinder and a lower end plate which blocks a lower side of the lower cylinder, an intermediate partition plate which is disposed between the upper cylinder and the lower cylinder and blocks the lower side of the upper cylinder and the upper side of the lower cylinder, a rotation shaft which is supported by a main bearing unit provided on the upper end plate and a sub-bearing unit provided on the lower end plate, and is rotated by the motor, an upper eccentric portion and a lower eccentric portion which are provided with a phase difference from each other in a rotation shaft, an upper piston which is fitted to the upper eccentric portion, revolves along an inner circumferential surface of the upper cylinder, and forms an upper cylinder chamber in the upper cylinder, a lower piston which is fitted to the lower eccentric portion, revolves along an inner circumferential surface of the lower cylinder, and forms a lower cylinder chamber in the lower cylinder, an upper vane which protrudes from an upper vane groove provided in the upper cylinder in the upper cylinder chamber, abuts against the upper piston, and divides the upper cylinder chamber into an upper inlet chamber and an upper compression chamber, a lower vane which protrudes from a lower vane groove provided in the lower cylinder in the lower cylinder chamber, abuts against the lower piston, and divides the lower cylinder chamber into a lower inlet chamber and a lower compression chamber, an upper end plate cover which covers the upper end plate, forms an upper end plate cover chamber between the upper end plate and the upper end plate cover, and has an upper end plate cover discharge hole that allows the upper end plate cover chamber and the inside of the compressor housing to communicate with each other, a lower endplate cover which covers the lower end plate and forms a lower end plate cover chamber between the lower end plate and the lower end plate cover, an upper discharge hole which is provided on the upper end plate and allows the upper compression chamber and an upper end plate cover chamber to communicate with each other, a lower discharge hole which is provided on the lower end plate and allows the lower compression chamber and a lower end plate cover chamber to communicate with each other, and a refrigerant path hole which penetrates the lower end plate, the lower cylinder, the intermediate partition plate, the upper cylinder, and the upper end plate, and communicates with the lower end plate cover chamber and the upper end plate cover chamber, the compressor including: an upper discharge valve which opens and closes the upper discharge hole; a lower discharge valve which opens and closes the lower discharge hole; an upper discharge valve accommodation concave portion which is provided on the upper end plate and extends in a shape of a groove from a position of the upper discharge hole; and a lower discharge valve accommodation concave portion which is provided on the lower end plate and extends in a shape of a groove from a position of the lower discharge hole, in which the lower end plate cover is formed in a plate-shape, in which a lower discharge chamber concave portion is formed on the lower end plate to overlap the lower discharge hole side of the lower discharge valve accommodation concave portion, in which the lower end plate cover chamber is configured of the lower discharge chamber concave portion and the lower discharge valve accommodation concave portion, in which the lower discharge chamber concave portion is formed within a fan-like range between straight lines that link the center of a first insertion hole and the center of a second insertion hole which are adjacent to each other among a plurality of insertion holes into which a fastening member that fastens the lower end plate cover, the lower end plate, the lower cylinder, the intermediate partition plate, the upper cylinder, the upper end plate, and the upper end plate cover is inserted and which are provided on a circumference around a rotation shaft to penetrate the lower endplate, the lower cylinder, the intermediate partition plate, the upper cylinder, and the upper end plate, and the center of the sub-bearing unit, in which the refrigerant path hole is configured of a plurality of holes which communicate with the lower discharge chamber concave portion while at least a part thereof overlaps the lower discharge chamber concave portion, are positioned between the lower vane groove and the first insertion hole in the lower cylinder, and are positioned between the upper vane groove and the first insertion hole in the upper cylinder, and in which, in the plurality of holes, sectional areas of cross sections of holes which are the closest to the lower vane groove and the upper vane groove are the smallest compared to the sectional areas of cross sections of other holes.

The invention is to suppress a reverse flow of a refrigerant compressed in an upper cylinder through a refrigerant path hole, to reduce a flow channel resistance of the refrigerant that flows through the refrigerant path hole, and to prevent deterioration of an efficiency of a rotary compressor.

DETAILED DESCRIPTION OF THE INVENTION

Hereinafter, the invention will be described in detail with reference to the drawings based on an aspect (example) for realizing the invention. The example and each modification example which will be described hereinafter may be realized by appropriately combining the examples within a range without any contradiction.

EXAMPLE

Figure 1:
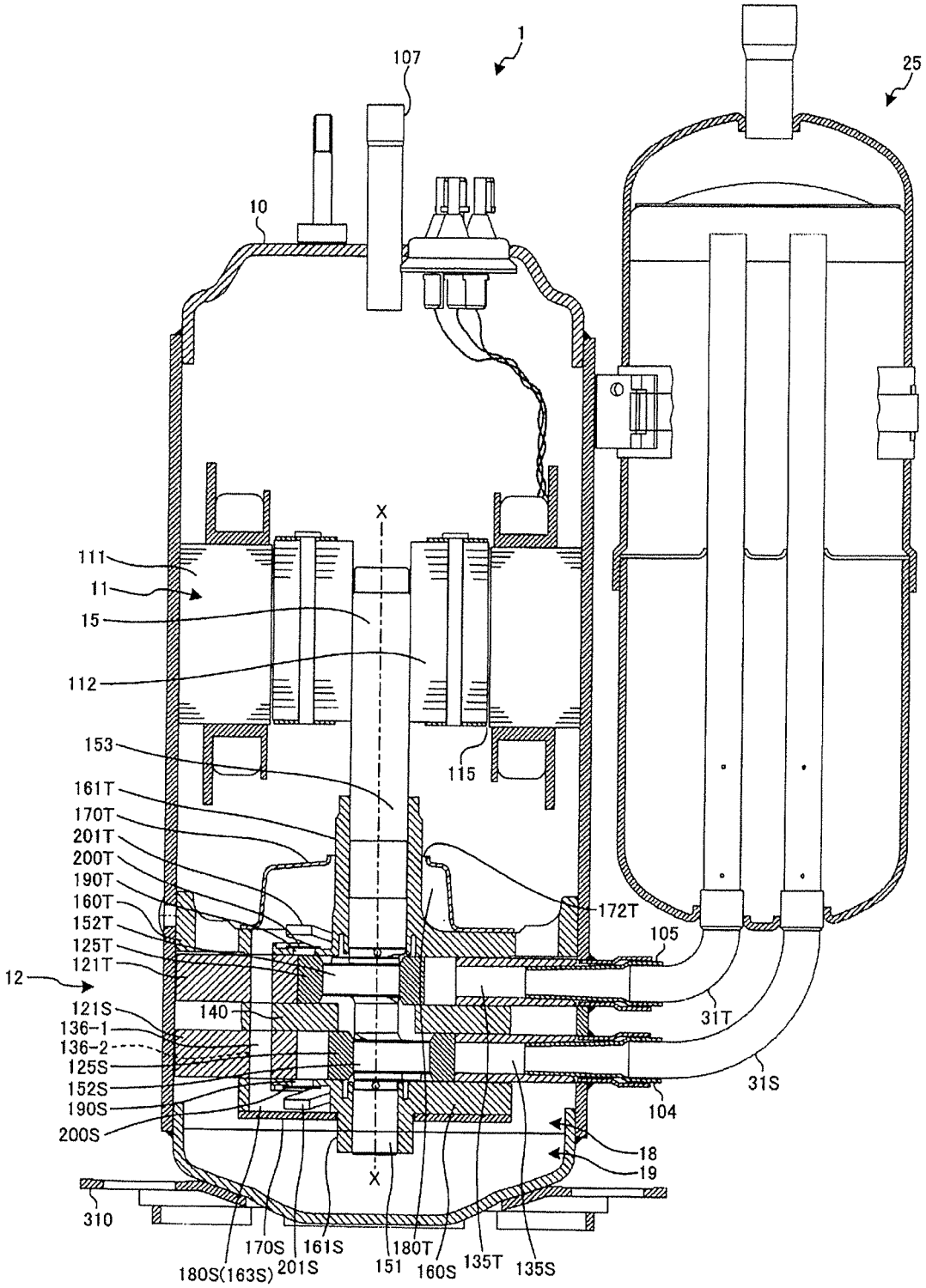
FIG. 1 is a longitudinal sectional view illustrating an example of a rotary compressor according to the invention.
Figure 2:
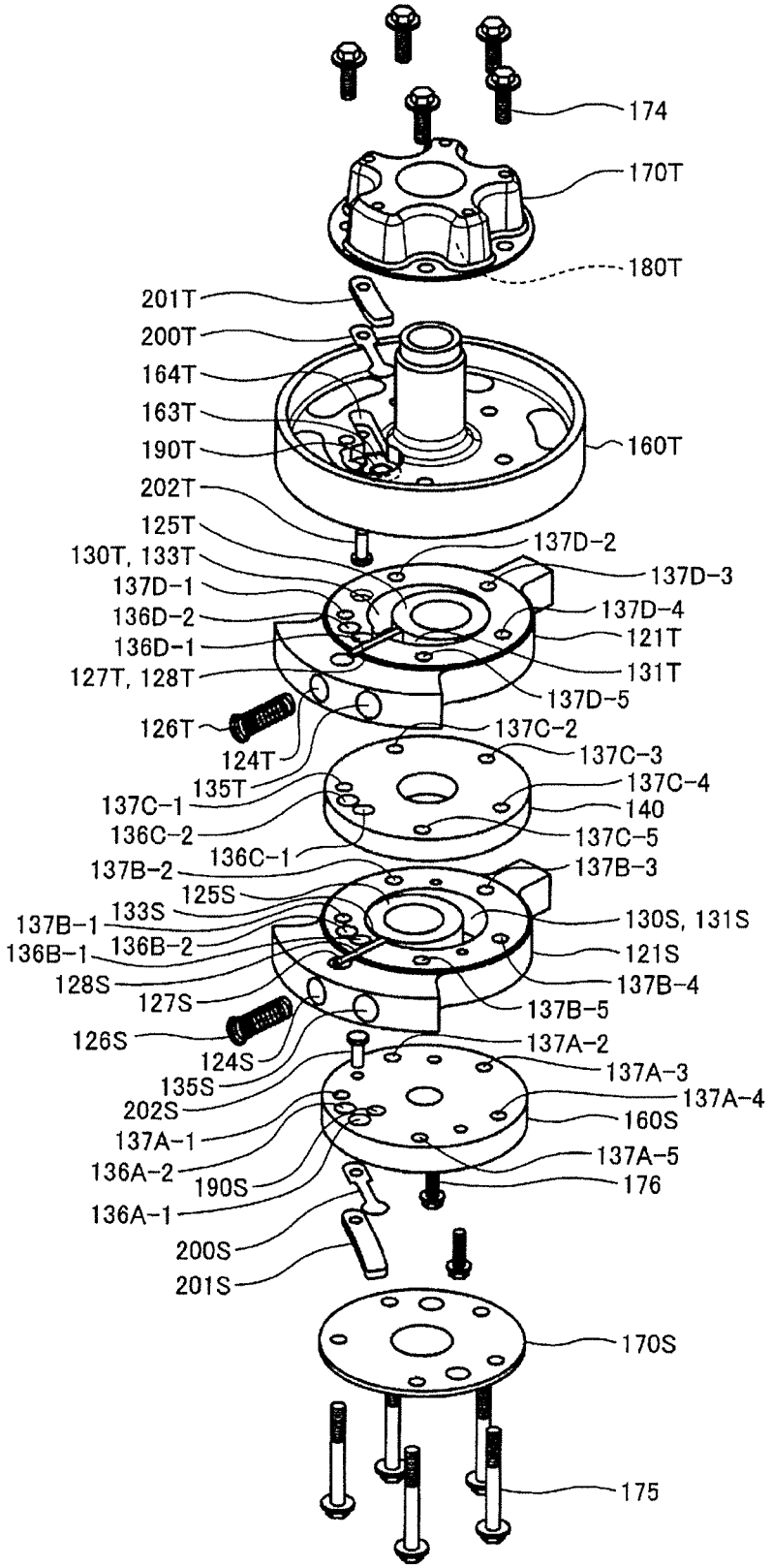
FIG. 2 is an upward exploded perspective view illustrating a compressing unit of the rotary compressor of the example.
Figure 3:
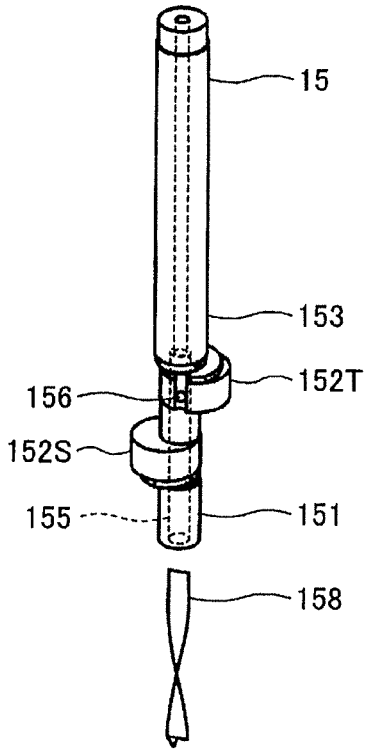
FIG. 3 is an upward exploded perspective view illustrating a rotation shaft and an oil feeding impeller of the rotary compressor of the example.

FIG. 1 is a longitudinal sectional view illustrating an example of a rotary compressor according to the invention, FIG. 2 is an upward exploded perspective view illustrating a compressing unit of the rotary compressor of the example, and FIG. 3 is an upper exploded perspective view illustrating a rotation shaft and an oil feeding impeller of the rotary compressor of the example.

As illustrated in FIG. 1, a rotary compressor 1 includes a compressing unit 12 which is disposed at a lower portion in a sealed vertically-placed cylindrical compressor housing 10, a motor 11 which is disposed above the compressing unit 12 and drives the compressing unit 12 via a rotation shaft 15, and a vertically placed cylindrical accumulator 25 which is fixed to a side portion of the compressor housing 10.

The accumulator 25 is connected to an upper inlet chamber 131T (refer to FIG. 2) of an upper cylinder 121T via an upper inlet pipe 105 and an accumulator upper curved pipe 31T, and is connected to a lower inlet chamber 131S (refer to FIG. 2) of a lower cylinder 121S via a lower inlet pipe 104 and an accumulator lower curved pipe 31S.

The motor 11 includes a stator ill disposed on an outer side, and a rotor 112 disposed on an inner side. The stator 111 is fixed in a shrink fit state to the inner circumferential surface of the compressor housing 10. The rotor 112 is fixed in a shrink fit state to the rotation shaft 15.

In the rotation shaft 15, a sub-shaft unit 151 at a lower part of a lower eccentric portion 152S is supported to be fitted to a sub-bearing unit 161S provided on a lower end plate 160S to be freely rotatable, and a main shaft unit 153 at an upper part of an upper eccentric portion 152T is supported to be fitted to a main bearing unit 161T provided on an upper end plate 160T to be freely rotatable. In the rotation shaft 15, the upper eccentric portion 152T and the lower eccentric portion 152S are provided with a phase difference from each other by 180 degrees, an upper piston 125T is supported by the upper eccentric portion 152T, and a lower piston 125S is supported by the lower eccentric portion 152S. Accordingly, the rotation shaft 15 is supported to be freely rotatable with respect to the entire compressing unit 12, the upper piston 125T is allowed to perform an orbital motion along an inner circumferential surface of the upper cylinder 121T by the rotation, and the lower piston 125S is allowed to perform an orbital motion along an inner circumferential surface of the lower cylinder 121S. Here, the rotation shaft 15 is supported by the main bearing unit 161T and the sub-bearing unit 161S, and the rotation shaft to be rotated is an X-X shaft.

On the inside of the compressor housing 10, in order to lubricate a sliding portion of the compressing unit 12 and to seal an upper compression chamber 133T (refer to FIG. 2) and a lower compression chamber 133S (refer to FIG. 2), lubricant oil 18 is sealed only by an amount by which the compressing unit 12 is substantially immersed. In a lower portion of the compressor housing 10 of the rotary compressor 1, a liquid refrigerant 19 remains. On a lower side of the compressor housing 10, an attachment leg 310 which locks a plurality of elastic supporting members (not illustrated) that support the entire rotary compressor 1 is fixed.

As illustrated in FIG. 2, the compressing unit 12 is configured to laminate an upper endplate cover 170T which has a dome-shaped bulging portion, the upper end plate 160T, the upper cylinder 121T, a intermediate partition plate 140, the lower cylinder 121S, the lower end plate 160S, and a plate-shaped lower end plate cover 170S, from above. The entire compressing unit 12 is fixed as each of a plurality of penetrating bolts 174 and 175 and an auxiliary bolt 176 which is vertically disposed substantially on a concentric circle is inserted into a plurality of bolt holes (a lower end plate first bolt hole 137A-1 to an upper end plate first bolt hole 137E-1, a lower end plate second bolt hole 137A-2 to an upper endplate second bolt hole 137E-2, a lower end plate third bolt hole 137A-3 to an upper end plate third bolt hole 137E-3, a lower end plate fourth bolt hole 137A-4 to an upper end fourth bolt hole 137E-4, a lower end plate fifth bolt hole 137A-5 to an upper end plate fifth bolt hole 137E-5) which are provided on the circumference around the rotation shaft 15. In addition, in the example, a case where the number of the penetrating bolts 174 and 175, the auxiliary bolt 176, and the bolt holes is five is described as an example, but the invention is not limited thereto.

In the annular upper cylinder 121T, an upper inlet hole 135T which is fitted to the upper inlet pipe 105 is provided. In the annular lower cylinder 121S, a lower inlet hole 135S which is fitted to the lower inlet pipe 104 is provided. In addition, in an upper cylinder chamber 130T of the upper cylinder 121T, the upper piston 125T is disposed. In a lower cylinder chamber 130S of the lower cylinder 121S, the lower piston 125S is disposed.

In the upper cylinder 121T, an upper vane groove 128T which extends outward in a radial shape from the center of the upper cylinder chamber 130T is provided, and in the upper vane groove 128T, an upper vane 127T is disposed. In the lower cylinder 121S, a lower vane groove 128S which extends outward in a radial shape from the center of the lower cylinder chamber 130S is provided, and in the lower vane groove 128S, a lower vane 127S is disposed.

In the upper cylinder 121T, an upper spring hole 124T is provided at a depth that does not penetrate the upper cylinder chamber 130T at a position which overlaps the upper vane groove 128T from the outside surface, and an upper spring 126T is disposed in the upper spring hole 124T. In the lower cylinder 121S, a lower spring hole 124S is provided at a depth that does not penetrate the lower cylinder chamber 130S at a position which overlaps the lower vane groove 128S from the outside surface, and a lower spring 126S is disposed in the lower spring 124S.

Upper and lower parts of the upper cylinder chamber 130T are respectively blocked by the upper end plate 160T and the intermediate partition plate 140. Upper and lower parts of the lower cylinder chamber 130S are respectively blocked by the intermediate partition plate 140 and the lower end plate 160S.

The upper cylinder chamber 130T is divided into the upper inlet chamber 131T which communicates with the upper inlet hole 135T, and the upper compression chamber 133T which communicates with an upper discharge hole 190T provided on the upper end plate 160T, as the upper vane 127T is pressed to the upper spring 126T and abuts against the outer circumferential surface of the upper piston 125T. The lower cylinder chamber 130S is divided into the lower inlet chamber 131S which communicates with the lower inlet hole 135S and the lower compression chamber 133S which communicates with a lower discharge hole 190S provided on the lower end plate 160S, as the lower vane 127S is pressed to the lower spring 126S and abuts against the outer circumferential surface of the lower piston 125S.

In the upper end plate 160T, the upper discharge hole 190T which penetrates the upper end plate 160T and communicates with the upper compression chamber 133T of the upper cylinder 121T is provided, and on an exit side of the upper discharge hole 190T, an annular upper valve seat (not illustrated) which surrounds the upper discharge hole 190T is formed. On the upper end plate 160T, an upper discharge valve accommodation concave portion 164T which extends in a shape of a groove toward an outer circumference of the upper end plate 160T from the position of the upper discharge hole 190T, is formed.

In the upper discharge valve accommodation concave portion 164T, all of a reed valve type upper discharge valve 200T in which a rear end portion is fixed by an upper rivet 202T in the upper discharge valve accommodation concave portion 164T and a front portion opens and closes the upper discharge hole 190T, and an upper discharge valve cap 201T in which a rear end portion overlaps the upper discharge valve 200T and is fixed by the upper rivet 202T in the upper discharge valve accommodation concave portion 164T, and the front portion is curved (arched) in a direction in which the upper discharge valve 200T is open, and regulates an opening degree of the upper discharge valve 200T, are accommodated.

On the lower end plate 160S, the lower discharge hole 190S which penetrates the lower end plate 160S and communicates with the lower compression chamber 133S of the lower cylinder 121S is provided, and on the exit side of the lower discharge hole 190S, an annular lower valve seat 191S (refer to FIG. 4) which surrounds the lower discharge hole 190S is formed. On the lower end plate 160S, a lower discharge valve accommodation concave portion 164S (refer to FIG. 4) which extends in a shape of a groove toward the outer circumference of the lower end plate 160S from the position of the lower discharge hole 190S is formed.

In the lower discharge valve accommodation concave portion 164S, all of a reed valve type lower discharge valve 200S in which a rear end portion is fixed by a lower rivet 202S in the lower discharge valve accommodation concave portion 164S and a front portion opens and closes the lower discharge hole 190S, and a lower discharge valve cap 201S in which a rear end portion overlaps the lower discharge valve 200S and is fixed by the lower rivet 202S in the lower discharge valve accommodation concave portion 164S, and the front portion is curved (arched) in a direction in which the lower discharge valve 200S is open, and regulates an opening degree of the lower discharge valve 200S, are accommodated.

Between the upper end plates 160T which tightly fixed to each other and the upper end plate cover 170T which includes the dome-shaped bulging portion, an upper end plate cover chamber 180T is formed. Between the lower endplates 160S which tightly fixed to each other and the plate-shaped lower endplate cover 170S, a lower end plate cover chamber 180S is formed. As a circular hole which forms a first refrigerant path hole 136-1 which penetrates the lower end plate 160S, the lower cylinder 121S, the intermediate partition plate 140, the upper cylinder 121T, and the upper end plate 160T and communicates the lower end plate cover chamber 180S and the upper end plate cover chamber 180T, a lower endplate first circular hole 136A-1 is provided on the lower end plate 160S, a lower cylinder first circular hole 136B-1 is provided in the lower cylinder 121S, an intermediate partition plate first circular hole 136C-1 is provided on the intermediate partition plate 140, an upper cylinder first circular hole 136D-1 is provided in the upper cylinder 121T, and an upper endplate first circular hole 136E-1 is provided on the upper end plate 160T, respectively. In addition, as a circular hole which forms a second refrigerant path hole 136-2 which penetrates the lower end plate 160S, the lower cylinder 121S, the intermediate partition plate 140, the upper cylinder 121T, and the upper end plate 160T, and communicates with the lower end plate cover chamber 180S and the upper end plate cover chamber 180T to be parallel to and independent from the first refrigerant path hole 136-1, a lower end plate second circular hole 136A-2 is provided on the lower end plate 160S, a lower cylinder second circular hole 136B-2 is provided in the lower cylinder 121S, an intermediate partition plate second circular hole 136C-2 is provided on the intermediate partition plate 140, an upper cylinder second circular hole 136D-2 is provided on the upper cylinder 121T, and an upper endplate second circular hole 136E-2 is provided on the upper end plate 160T, respectively Hereinafter, in a case where the first refrigerant path hole 136-1 and the second refrigerant path hole 136-2 are integrally called, the holes are called a refrigerant path hole 136.

As illustrated in FIG. 3, in the rotation shaft 15, an oil feeding vertical hole 155 which penetrates from a lower end to an upper end is provided, and an oil feeding impeller 158 is pressurized to the oil feeding vertical hole 155. In addition, on the side surface of the rotation shaft 15, a plurality of oil feeding horizontal holes 156 which communicate with the oil feeding vertical hole 155 are provided.

Hereinafter, a flow of the refrigerant caused by the rotation of the rotation shaft 15 will be described. In the upper cylinder chamber 130T, by the rotation of the rotation shaft 15, as the upper piston 125T fitted to the upper eccentric portion 152T of the rotation shaft 15 revolves along the outer circumferential surface (inner circumferential surface of the upper cylinder 121T) of the upper cylinder chamber 130T, the refrigerant is suctioned from the upper inlet pipe 105 while the capacity of the upper inlet chamber 131T expands, the refrigerant is compressed while the capacity of the upper compression chamber 133T is reduced, and the pressure of the compressed refrigerant becomes higher than the pressure of the upper end plate cover chamber 180T on the outer side of the upper discharge valve 200T, and then, the upper discharge valve 200T is open and the refrigerant is discharged to the upper end plate cover chamber 180T from the upper compression chamber 133T. The refrigerant discharged to the upper end plate cover chamber 180T is discharged to the inside of the compressor housing 10 from an upper end plate cover discharge hole 172T (refer to FIG. 1) provided in the upper end plate cover 170T.

In addition, in the lower cylinder chamber 130S, by the rotation of the rotation shaft 15, as the lower piston 125S fitted to the lower eccentric portion 152S of the rotation shaft 15 revolves along the outer circumferential surface (inner circumferential surface of the lower cylinder 121S) of the lower cylinder chamber 130S, the refrigerant is suctioned from the lower inlet pipe 104 while the capacity of the lower inlet chamber 131S expands, the refrigerant is compressed while the capacity of the lower compression chamber 133S is reduced, and the pressure of the compressed refrigerant becomes higher than the pressure of the lower end plate cover chamber 180S on the outer side of the lower discharge valve 200S, and then, the lower discharge valve 200S is open and the refrigerant is discharged to the lower end plate cover chamber 180S from the lower compression chamber 133S. The refrigerant discharged to the lower endplate cover chamber 180S is discharged to the inside of the compressor housing 10 from the upper end plate cover discharge hole 172T (refer to FIG. 1) provided in the upper end plate cover 170T through the first refrigerant path hole 136-1, the second refrigerant path hole 136-2, and the upper end plate cover chamber 180T.

The refrigerant discharged to the inside of the compressor housing 10 is guided to the upper part of the motor 11 through a cutout (not illustrated) which is provided at an outer circumference of the stator 111 and vertically communicates, a void (not illustrated) of a winding unit of the stator 111, or a void 115 (refer to FIG. 1) between the stator 111 and the rotor 112, and is discharged from a discharge pipe 107 in the upper portion of the compressor housing 10.

Hereinafter, a flow of the lubricant oil 18 will be described. The lubricant oil 18 passes through the oil feeding vertical hole 155 and the plurality of oil feeding horizontal holes 156 from the lower end of the rotation shaft 15, is supplied to a sliding surface between the sub-bearing unit 161S and the sub-shaft unit 151 of the rotation shaft 15, a sliding surface between the main bearing unit 161T and the main shaft unit 153 of the rotation shaft 15, a sliding surface between the lower eccentric portion 152S of the rotation shaft 15 and the lower piston 125S, and a sliding surface between the upper eccentric portion 152T and the upper piston 125T, and lubricates each of the sliding surfaces.

In a case where the lubricant oil 18 is suctioned up by giving a centrifugal force to the lubricant oil 18 in the oil feeding vertical hole 155, the lubricant oil 18 is discharged together with the refrigerant from the inside of the compressor housing 10, and an oil level is lowered, the oil feeding impeller 158 reliably plays a role of supplying the lubricant oil 18 on the sliding surfaces.

Figure 4:
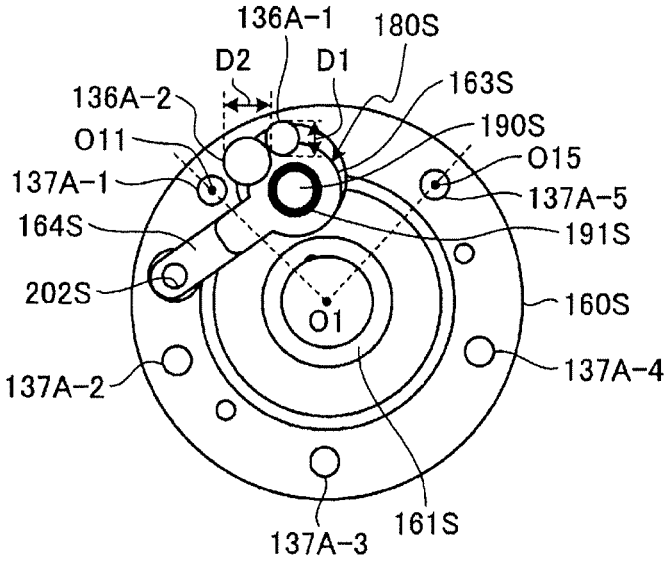
FIG. 4 is a bottom view illustrating a lower end plate of the rotary compressor of the example.
Figure 5:
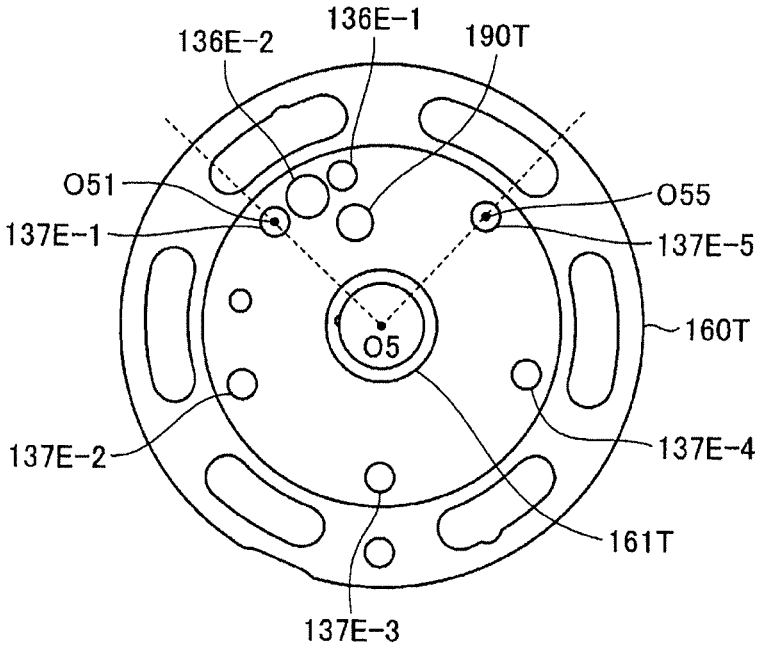
FIG. 5 is a bottom view illustrating an upper end plate of the rotary compressor of the example.

Next, a characteristic configuration of the rotary compressor 1 of the example will be described. FIG. 4 is a bottom view illustrating a lower end plate of the rotary compressor of the example. FIG. 5 is a bottom view illustrating an upper end plate of the rotary compressor of the example.

As illustrated in FIG. 4, since the lower end plate cover 170S is a plate-shaped and does not include the dome-shaped bulging portion similar to the upper end plate cover 170T, the lower end plate cover chamber 180S is configured of a lower discharge chamber concave portion 163S and the lower discharge valve accommodation concave portion 164S which are provided on the lower end plate 160S. The lower discharge valve accommodation concave portion 164S extends in a direction intersecting with a diametrical line that links the center of the sub-bearing unit 161S and the center of the lower discharge hole 190S, that is, toward the outer circumference of the lower end plate 160S, linearly in a shape of a groove from the position of the lower discharge hole 190S. The lower discharge valve accommodation concave portion 164S is connected to the lower discharge chamber concave portion 163S. The lower discharge valve accommodation concave portion 164S is formed such that the width thereof is slightly greater than the widths of the lower discharge valve 200S and the lower discharge valve cap 201S, accommodates the lower discharge valve 200S and the lower discharge valve cap 201S therein, and positions the lower discharge valve 200S and the lower discharge valve cap 201S.

The lower discharge chamber concave portion 163S is formed at the depth which is the same as the depth of the lower discharge valve accommodation concave portion 164S to overlap the lower discharge hole 190S side of the lower discharge valve accommodation concave portion 164S. The lower discharge hole 190S side of the lower discharge valve accommodation concave portion 164S is accommodated in the lower discharge chamber concave portion 163S.

The lower discharge chamber concave portion 163S is formed in a first fan-like range on a plane of the lower end plate 160S which is divided by a straight line that links a center O1 of the lower end plate 160S through which the X-X shaft passes and a center O11 of the lower end plate first bolt hole 137A-1, (i.e., "first insertion hole"), and a straight line that links the center O1 and a center O15 of the lower end plate fifth bolt hole 137A-5 (i.e., "second insertion hole"). On the lower end plate 160S, the lower end plate first circular hole 136A-1 is positioned within the first fan-like range, that is, at a position at which at least a part thereof overlaps the lower discharge chamber concave portion 163S and communicates with the lower discharge chamber concave portion 163S. The lower end plate second circular hole 136A-2 is provided within the first fan-like range, that is, at a position at which at least a part thereof overlaps the lower discharge chamber concave portion 163S, communicates with the lower discharge chamber concave portion 163S, and is adjacent to the lower endplate first circular hole 136A-1. The lower endplate first circular hole 136A-1 is provided at a position which is more separated from the lower end plate first bolt hole 137A-1 than the lower end plate second circular hole 136A-2. In other words, the lower end plate second circular hole 136A-2 is provided to be closer to the lower end plate first bolt hole 137A-1 than the lower end plate first circular hole 136A-1.

Here, on the lower end plate 160S, the total sectional area of the cross sections of the lower end plate first circular hole 136A-1 and the lower end plate second circular hole 136A-2 has the maximum size that does not interfere with other elements of the lower end plate 160S. In addition, the sectional area of the cross section of the lower end plate second circular hole 136A-2 is greater than the sectional area of the cross section of the lower end plate first circular hole 136A-1. For example, as illustrated in FIG. 4, a hole diameter D2 of the lower end plate second circular hole 136A-2 is greater than a hole diameter D1 of the lower end plate first circular hole 136A-1.

At a circumferential edge of an opening portion of the lower discharge hole 190S, the annular lower valve seat 191S which is elevated with respect to a bottom portion of the lower discharge chamber concave portion 163S is formed, and the lower valve seat 191S abuts against the front portion of the lower discharge valve 200S. In the shaft direction of the rotation shaft 15, when the refrigerant is discharged from the lower discharge hole 190S, the lower discharge valve 200S is lifted only by a predetermined opening angle with respect to the lower valve seat 191S not to reach the resistance of the discharge flow.

In addition, although not illustrated, the lower cylinder 121S, the intermediate partition plate 140, and the upper cylinder 121T are also similar to the lower end plate 160S. In other words, in the lower cylinder 121S, the lower cylinder first circular hole 136B-1 and the lower cylinder second circular hole 136B-2 are provided to be adjacent to each other within a second fan-like range on a plane of the lower cylinder 121S which is divided by a straight line that links a center O2 of the lower cylinder 121S through which the X-X shaft passes and the center of the lower cylinder first bolt hole 137B-1, and a straight line that links the center O2 and the center of the fifth bolt hole 137B-5. The lower cylinder first circular hole 136B-1 is provided at a position which is more separated from the lower cylinder first bolt hole 137B-1 than the lower cylinder second circular hole 136B-2. In other words, the lower cylinder second circular hole 136B-2 is provided to be closer to the lower cylinder first bolt hole 137B-1 than the lower cylinder first circular hole 136B-1.

Here, in the lower cylinder 121S, the total sectional area of the cross sections of the lower cylinder first circular hole 136B-1 and the lower cylinder second circular hole 136B-2 has the maximum size that does not interfere with other mechanical elements, for example, the lower vane groove 128S, of the lower cylinder 121S. In addition, the sectional area of the cross section of the lower cylinder second circular hole 136B-2 is greater than the sectional area of the cross section of the lower cylinder first circular hole 136B-1. For example, a hole diameter of the lower cylinder second circular hole 136B-2 is greater than a hole diameter of the lower cylinder first circular hole 136B-1.

In addition, on the intermediate partition plate 140, the intermediate partition plate first circular hole 136C-1 and the intermediate partition plate second circular hole 136C-2 are provided to be adjacent to each other within a third fan-like range on a plane of the intermediate partition plate 140 which is divided by a straight line that links a center O3 of the intermediate partition plate 140 through which the X-X shaft passes and the center of the intermediate partition plate first bolt hole 137C-1, and a straight line that links the center O3 and the center of the fifth bolt hole 137C-5. The intermediate partition plate first circular hole 136C-1 is provided at a position which is more separated from the intermediate partition plate first bolt hole 137C-1 than the intermediate partition plate second circular hole 136C-2. In other words, the intermediate partition plate second circular hole 136C-2 is provided to be closer to the intermediate partition plate first bolt hole 137C-1 than the intermediate partition plate first circular hole 136C-1.

Here, on the intermediate partition plate 140, the total sectional area of the cross sections of the intermediate partition plate first circular hole 136C-1 and the intermediate partition plate second circular hole 136C-2 has the maximum size that does not interfere with other mechanical elements of the intermediate partition plate 140, such as an injection pipe, a connection hole of the injection pipe, or an injection hole. In addition, the sectional area of the cross section of the intermediate partition plate second circular hole 136C-2 is greater than the sectional area of the cross section of the intermediate partition plate first circular hole 136C-1. For example, a hole diameter of the intermediate partition plate second circular hole 136C-2 is greater than a hole diameter of the intermediate partition plate first circular hole 136C-1.

In addition, in the upper cylinder 121T, the upper cylinder first circular hole 136D-1 and the upper cylinder second circular hole 136D-2 are provided to be adjacent to each other within a fourth fan-like range on a plane of the upper cylinder 121T which is divided by a straight line that links a center O4 of the upper cylinder 121T through which the X-X shaft passes and the center of the upper cylinder first bolt hole 137D-1, and a straight line that links the center O4 and the center of the fifth bolt hole 137D-5. The upper cylinder second circular hole 136D-2 is provided within the fourth fan-like range, that is, at a position which is adjacent to the upper cylinder first circular hole 136D-1. The upper cylinder first circular hole 136D-1 is provided at a position which is more separated from the upper cylinder first bolt hole 137D-1 than the upper cylinder second circular hole 136D-2. In other words, the upper cylinder second circular hole 136D-2 is provided to be closer to the upper cylinder first bolt hole 137D-1 than the upper cylinder first circular hole 136D-1.

Here, in the upper cylinder 121T, the total sectional area of the cross sections of the upper cylinder first circular hole 136D-1 and the upper cylinder second circular hole 136D-2 has the maximum size that does not interfere with other mechanical elements, for example, the upper vane groove 128T, of the upper cylinder 121T. In addition, the sectional area of the cross section of the upper cylinder second circular hole 136D-2 is greater than the sectional area of the cross section of the upper cylinder first circular hole 136D-1. For example, a hole diameter of the upper cylinder second circular hole 136D-2 is greater than a hole diameter of the upper cylinder first circular hole 136D-1.

The upper end plate cover chamber 180T is configured of the dome-shaped bulging portion of the upper end plate cover 170T, an upper discharge chamber concave portion 163T provided on the upper end plate 160T, and the upper discharge valve accommodation concave portion 164T. The upper discharge valve accommodation concave portion 164T extends in a direction intersecting with the diametrical line that links the center of the main bearing unit 161T and the center of the upper discharge hole 190T, that is, in a circumferential direction of the upper end plate 160T, linearly in a shape of a groove from the position of the upper discharge hole 190T. The upper discharge valve accommodation concave portion 164T is connected to the upper discharge chamber concave portion 163T. The upper discharge valve accommodation concave portion 164T is formed such that the width thereof is slightly greater than the widths of the upper discharge valve 200T and the upper discharge valve cap 201T, accommodates the upper discharge valve 200T and the upper discharge valve cap 201T therein, and positions the upper discharge valve 200T and the upper discharge valve cap 201T.

The upper discharge chamber concave portion 163T is formed at the depth which is the same as the depth of the lower discharge valve accommodation concave portion 164S to overlap the upper discharge hole 190T side of the upper discharge valve accommodation concave portion 164T. The upper discharge hole 190T side of the upper discharge valve accommodation concave portion 164T is accommodated in the upper discharge chamber concave portion 163T.

The upper discharge chamber concave portion 163T is formed within a fifth fan-like range on a plane of the upper end plate 160T which is divided by a straight line that links a center O5 of the upper end plate 160T through which the X-X shaft passes and a center O51 of the upper end plate first bolt hole 137E-1, and a straight line that links the center O5 and a center O55 of the fifth bolt hole 137E-5. The upper end plate first circular hole 136E-1 is provided within the fifth fan-like range, that is, at a position at which at least a part thereof overlaps the upper discharge chamber concave portion 163T and communicates with the upper discharge chamber concave portion 163T. The upper end plate second circular hole 136E-2 is provided within the fifth fan-like range, that is, at a position at which at least a part thereof overlaps the lower discharge chamber concave portion 163S, communicates with the upper discharge chamber concave portion 163T, and is adjacent to the upper end plate first circular hole 136E-1. The upper end plate first circular hole 136E-1 is provided at a position which is more separated from the upper end plate first bolt hole 137E-1 than the upper end plate second circular hole 136E-2. In other words, the upper end plate second circular hole 136E-2 is provided to be closer to the upper end plate first bolt hole 137E-1 than the upper end plate first circular hole 136E-1.

Here, on the upper end plate 160T, the total sectional area of the cross sections of the upper endplate first circular hole 136E-1 and the upper end plate second circular hole 136E-2 has the maximum size that does not interfere with other mechanical elements of the upper end plate 160T. In addition, the sectional area of the cross section of the upper end plate second circular hole 136E-2 is greater than the sectional area of the cross section of the upper end plate first circular hole 136E-1. For example, a hole diameter of the upper end plate second circular hole 136E-2 is greater than a hole diameter of the upper end plate first circular hole 136E-1.

In addition, the sectional areas of each of the cross sections of the lower end plate first circular hole 136A-1 to the upper end plate first circular hole 136E-1 may be the same as each other. Similarly, the sectional areas of each of the cross sections of the lower end plate second circular hole 136A-2 to the upper end plate second circular hole 136E-2 may be the same as each other. In FIG. 1, for the convenience, the sectional areas of the cross sections of the lower end plate first circular hole 136A-1 to the upper endplate first circular hole 136E-1 (or the sectional areas of each of the cross sections of the lower end plate second circular hole 136A-2 to the upper end plate second circular hole 136E-2) are illustrated as substantially the same as each other.

By the configuration of the above-described rotary compressor 1 of the example, the sectional area of the cross section of the first refrigerant path hole 136-1 is small compared to the sectional area of the cross section of the second refrigerant path hole 136-2 in order to avoid interference with the other mechanical elements, such as the lower vane groove 128S and the upper vane groove 128T, but even when avoiding the interference with the other mechanical elements from the position, the sectional area of the cross section of the second refrigerant path hole 136-2 can be greater than the sectional area of the cross section of the first refrigerant path hole 136-1. Accordingly, by setting the sectional area of the cross section of the second refrigerant path hole 136-2 to be greater than the sectional area of the cross section of the first refrigerant path hole 136-1, it is possible to reduce the flow channel resistance of the refrigerant that flows through the first refrigerant path hole 136-1 and the second refrigerant path hole 136-2, and to improve the compression efficiency of the rotary compressor 1.

In addition, by the configuration of the above-described rotary compressor 1 of the example, it is possible to reduce the flow channel resistance of the refrigerant which flows through the first refrigerant path hole 136-1 and the second refrigerant path hole 136-2. Accordingly, it is possible to reduce the driving sound of the rotary compressor 1.

In addition, by the configuration of the above-described rotary compressor 1 of the example, the holes which form the first refrigerant path hole 136-1 and the second refrigerant path hole 136-2 and are respectively provided in the lower end plate 160S, the lower cylinder 121S, the intermediate partition plate 140, the upper cylinder 121T, and the upper end plate 160T, are set to have a circular shape similar to the lower end plate first circular hole 136A-1 to the upper end plate first circular hole 136E-1, and the lower end plate second circular hole 136A-2 to the upper end plate second circular hole 136E-2. Accordingly, since it is possible to form the lower end plate first circular hole 136A-1 to the upper end plate first circular hole 136E-1 and the lower end plate second circular hole 136A-2 to the upper end plate second circular hole 136E-2, by using a common drill blade, such as a bolt hole, it is possible to reduce the number of processing, and to reduce the processing costs.

In addition, by the configuration of the above-described rotary compressor 1 of the example, when the total sectional area of the cross sections of the first refrigerant path hole 136-1 and the second refrigerant path hole 136-2 is greater than that of the related art, since it is possible to set the outer diameter of the component of the rotary compressor 1 to be the same as that of the component of the related art, and to use the component similar to the related art, it is possible to reduce the component costs and the processing costs.

In addition, in the above-described example, two refrigerant path holes 136, such as the first refrigerant path hole 136-1 and the second refrigerant path hole 136-2, are provided, but three or more holes may be provided. In this case, in each of the lower end plate 160S, the lower cylinder 121S, the intermediate partition plate 140, the upper cylinder 121T, and the upper end plate 160T, the sectional areas of the cross sections of the circular holes which form the refrigerant path hole 136 that is closest to the lower vane groove 128S and the upper vane groove 128T is the smallest compared to the sectional areas of the cross sections of other circular holes.

In addition, in the above-described example, two refrigerant path holes 136, such as the first refrigerant path hole 136-1 and the second refrigerant path hole 136-2 are provided to be adjacent to each other, but two first refrigerant path hole 136-1 and the second refrigerant path hole 136-2 may be provided to be connected to each other. In other words, the lower end plate first circular hole 136A-1 and the lower end plate second circular hole 136A-2 to the upper end plate first circular hole 136E-1 and the upper end plate second circular hole 136E-2, may be provided to be connected to each other.

In addition, in the above-described example, similar to the lower end plate first circular hole 136A-1 to the upper end plate first circular hole 136E-1 and the lower end plate second circular hole 136A-2 to the upper end plate second circular hole 136E-2, the holes which form the first refrigerant path hole 136-1 and the second refrigerant path hole 136-2 are circular holes. However, the holes which form the first refrigerant path hole 136-1 and the second refrigerant path hole 136-2 are not limited to the circular holes, and may have any shape, such as an elliptical shape, as long as the hole has a sectional shape that suppresses a reverse flow of the refrigerant compressed in the upper cylinder chamber 130T through the refrigerant path hole 136, and reduces the flow channel resistance of the refrigerant that flows through the refrigerant path hole 136.

In addition, in the above-described example, size relationships, such as the sectional area of the cross section of the lower end plate first circular hole 136A-1<the sectional area of the cross section of the lower end plate second circular hole 136A-2, the sectional area of the cross section of the lower cylinder first circular hole 136B-1<the sectional area of the cross section of the lower cylinder second circular hole 136B-2, the sectional area of the cross section of the intermediate partition plate first circular hole 136C-1<the sectional area of the cross section of the intermediate partition plate second circular hole 136C-2, the sectional area of the cross section of the upper cylinder first circular hole 136D-1<the sectional area of the cross section of the upper cylinder second circular hole 136D-2, and the sectional area of the cross section of the upper end plate first circular hole 136E-1<the sectional area of the cross section of the upper end plate second circular hole 136E-2, are described. However, not being limited thereto, for example, at least any of the size relationships among the sectional area of the cross section of the lower end plate first circular hole 136A-1<the sectional area of the cross section of the lower end plate second circular hole 136A-2, the sectional area of the cross section of the lower cylinder first circular hole 136B-1<the sectional area of the cross section of the lower cylinder second circular hole 136B-2, the sectional area of the cross section of the intermediate partition plate first circular hole 136C-1<the sectional area of the cross section of the intermediate partition plate second circular hole 136C-2, the sectional area of the cross section of the upper cylinder first circular hole 136D-1<the sectional area of the cross section of the upper cylinder second circular hole 136D-2, and the sectional area of the cross section of the upper end plate first circular hole 136E-1<the sectional area of the cross section of the upper end plate second circular hole 136E-2, may be established. Specifically, for example, at least in the lower cylinder 121S and/or the upper cylinder 121T, at least any of the size relationships among the sectional area of the cross section of the lower cylinder first circular hole 136B-1<the sectional area of the cross section of the lower cylinder second circular hole 136B-2, and the sectional area of the cross section of the upper cylinder first circular hole 136D-1<the sectional area of the cross section of the upper cylinder second circular hole 136D-2, may be established. As the second refrigerant path hole 136-2 includes a second circular hole of which the sectional area of the cross section is greater than that of the first circular hole, in any of the lower end plate 160S, the lower cylinder 121S, the intermediate partition plate 140, the upper cylinder 121T, and the upper end plate 160T, the flow channel resistance of the second refrigerant path hole 136-2 in the members is further reduced.

In addition, in the above-described example, on the lower end plate 160S, the total area of the cross sections of the lower end plate first circular hole 136A-1 and the lower end plate second circular hole 136A-2 is the maximum size by which the lower end plate first circular hole 136A-1 and the lower end plate second circular hole 136A-2 do not interfere with other mechanical elements, but the invention is not limited to the maximum size. The lower cylinder first circular hole 136B-1 and the lower cylinder second circular hole 136B-2, the intermediate partition plate first circular hole 136C-1 and the intermediate partition plate second circular hole 136C-2, the upper cylinder first circular hole 136D-1 and the upper cylinder second circular hole 136D-2, and the upper end plate first circular hole 136E-1 and the upper end plate second circular hole 136E-2, are also similar thereto.

Above, the examples are described, but the examples are not limited by the above-described contents. In addition, in the above-described configuration elements, elements which can be easily assumed by those skilled in the art, elements which are substantially the same, and elements which are in a so-called equivalent range, are included. Furthermore, the above-described configuration elements can be appropriately combined with each other. Furthermore, at least one of various omissions, replacements, and changes of the configuration elements can be performed within the range that does not depart from the scope of the example.

What is claimed is:

1. A rotary compressor which includes a sealed vertically-placed cylindrical compressor housing which is provided with a discharge pipe that discharges a refrigerant in an upper portion of the compressor housing, which is provided with an upper inlet pipe and a lower inlet pipe that suction the refrigerant in a lower portion of a side surface of the compressor housing, an accumulator which is connected to the upper inlet pipe and the lower inlet pipe that are fixed to a side portion of the compressor housing, a motor which is disposed in the compressor housing, and a compressing unit which is disposed below the motor in the compressor housing, is driven by the motor, suctions and compresses the refrigerant from the accumulator via the upper inlet pipe and the lower inlet pipe, and discharges the refrigerant from the discharge pipe, and in which the compressing unit includes an annular upper cylinder and an annular lower cylinder, an upper end plate which blocks an upper side of the upper cylinder and a lower end plate which blocks a lower side of the lower cylinder, an intermediate partition plate which is disposed between the upper cylinder and the lower cylinder and blocks the lower side of the upper cylinder and the upper side of the lower cylinder, a rotation shaft which is supported by a main bearing unit provided on the upper end plate and a sub-bearing unit provided on the lower end plate, and is rotated by the motor, an upper eccentric portion and a lower eccentric portion which are provided with a phase difference from each other in a rotation shaft, an upper piston which is fitted to the upper eccentric portion, revolves along an inner circumferential surface of the upper cylinder, and forms an upper cylinder chamber in the upper cylinder, a lower piston which is fitted to the lower eccentric portion, revolves along an inner circumferential surface of the lower cylinder, and forms a lower cylinder chamber in the lower cylinder, an upper vane which protrudes from an upper vane groove provided in the upper cylinder in the upper cylinder chamber, abuts against the upper piston, and divides the upper cylinder chamber into an upper inlet chamber and an upper compression chamber, a lower vane which protrudes from a lower vane groove provided in the lower cylinder in the lower cylinder chamber, abuts against the lower piston, and divides the lower cylinder chamber into a lower inlet chamber and a lower compression chamber, an upper end plate cover which covers the upper end plate, forms an upper end plate cover chamber between the upper end plate and the upper end plate cover, and has an upper end plate cover discharge hole that allows the upper end plate cover chamber and the inside of the compressor housing to communicate with each other, a lower end plate cover which covers the lower end plate and forms a lower end plate cover chamber between the lower end plate and the lower end plate cover, an upper discharge hole which is provided on the upper end plate and allows the upper compression chamber and the upper end plate cover chamber to communicate with each other, a lower discharge hole which is provided on the lower end plate and allows the lower compression chamber and the lower end plate cover chamber to communicate with each other, and a refrigerant path hole which penetrates the lower end plate, the lower cylinder, the intermediate partition plate, the upper cylinder, and the upper end plate, and communicates with the lower end plate cover chamber and the upper end plate cover chamber, the compressor comprising:

an upper discharge valve which opens and closes the upper discharge hole;

a lower discharge valve which opens and closes the lower discharge hole;

an upper discharge valve accommodation concave portion which is provided on the upper end plate and extends in a shape of a groove from a position of the upper discharge hole; and a lower discharge valve accommodation concave portion which is provided on the lower end plate and extends in a shape of a groove from a position of the lower discharge hole, wherein the lower end plate cover is formed in a plate shape, wherein a lower discharge chamber concave portion is formed on the lower end plate to overlap the lower discharge hole side of the lower discharge valve accommodation concave portion, wherein the lower end plate cover chamber is configured of the lower discharge chamber concave portion and the lower discharge valve accommodation concave portion, wherein the lower discharge chamber concave portion is, in the lower end plate, formed within a fan-like range between straight lines that link a center of a first insertion hole and a center of a second insertion hole which are adjacent to each other among a plurality of insertion holes into which a fastening member that fastens the lower end plate cover, the lower end plate, the lower cylinder, the intermediate partition plate, the upper cylinder, the upper end plate, and the upper end plate cover is inserted and which are provided on a circumference around a rotation shaft to penetrate the lower end plate, the lower cylinder, the intermediate partition plate, the upper cylinder, and the upper end plate, and the center of the sub-bearing unit, wherein the refrigerant path hole is configured of a plurality of holes which communicate with the lower discharge chamber concave portion while at least a part thereof overlaps the lower discharge chamber concave portion, are positioned between the lower vane groove and the first insertion hole in the lower cylinder, and are positioned between the upper vane groove and the first insertion hole in the upper cylinder, and wherein sectional areas of cross sections of holes which are the closest to the lower vane groove and the upper vane groove in the plurality of holes are less than the sectional areas of cross sections of other holes, wherein the sectional areas of each of the cross sections of the plurality of holes have a maximum size that does not interfere with other mechanical elements in each of the lower end plate, the lower cylinder, the intermediate partition plate, the upper cylinder, and the upper end plate, and wherein, in the lower cylinder, total sectional area of the cross sections of a lower cylinder first circular hole and a lower cylinder second circular hole has a maximum size that does not interfere with the lower vane groove which is another mechanical element of the lower cylinder.

2. The rotary compressor according to claim 1, wherein each of the plurality of holes is a circular hole.

* * * * *